US005839973A

United States Patent [19]

Jackson

[11] Patent Number: 5,839,973

[45] Date of Patent: Nov. 24, 1998

[54] GOLF CLUB HEAD WITH ENLARGED HOSEL

[76] Inventor: Al Jackson, 2590 Pioneer Ave., Vista, Calif. 92083

[21] Appl. No.: 745,215

[22] Filed: Nov. 8, 1996

Related U.S. Application Data

[63] Continuation-in-part of Ser. No. 58,549, Aug. 19, 1996.

[51] Int. Cl.[6] ..... A63B 53/02

[52] U.S. Cl. ..... 473/305; 473/507; 473/308; 473/314

[58] Field of Search ..... 473/305, 307, 473/314, 308, 248, 246, 288

[56] References Cited

U.S. PATENT DOCUMENTS

| | | | |
|---|---|---|---|
| Re. 34,925 | 5/1995 | McKeighen . | |
| 669,864 | 3/1901 | Simpson | 473/314 |
| 1,553,867 | 6/1925 | Maas | 473/308 |
| 1,643,250 | 9/1927 | Longsworth | 473/248 |
| 2,067,556 | 1/1937 | Wettlaufer | 473/314 X |
| 3,625,513 | 12/1971 | Ballmer . | |
| 3,907,446 | 9/1975 | Leslie . | |
| 3,941,390 | 3/1976 | Hussey . | |
| 4,995,609 | 2/1991 | Parente et al. . | |
| 5,042,806 | 8/1991 | Helmstetter . | |
| 5,067,711 | 11/1991 | Parente et al. . | |
| 5,067,715 | 11/1991 | Schmidt et al. . | |
| 5,116,047 | 5/1992 | Phelan et al. | 473/307 |
| 5,163,682 | 11/1992 | Schmidt et al. . | |
| 5,165,688 | 11/1992 | Schmidt et al. . | |
| 5,180,166 | 1/1993 | Schmidt et al. . | |
| 5,204,046 | 4/1993 | Schmidt . | |
| 5,222,734 | 6/1993 | Parente et al. . | |
| 5,240,252 | 8/1993 | Schmidt et al. . | |
| 5,244,205 | 9/1993 | Melanson et al. | 473/248 |
| 5,275,399 | 1/1994 | Schmidt et al. . | |
| 5,282,625 | 2/1994 | Schmidt et al. . | |
| 5,301,946 | 4/1994 | Schmidt et al. . | |
| 5,308,062 | 5/1994 | Hogan . | |
| 5,314,184 | 5/1994 | Schmidt et al. . | |
| 5,318,300 | 6/1994 | Schmidt et al. . | |
| 5,320,347 | 6/1994 | Parente et al. . | |
| 5,330,187 | 7/1994 | Schmidt et al. . | |
| 5,335,914 | 8/1994 | Long . | |
| 5,344,150 | 9/1994 | Schmidt et al. . | |
| 5,348,295 | 9/1994 | Phillips | 473/314 X |
| 5,351,958 | 10/1994 | Helmstetter . | |
| 5,409,229 | 4/1995 | Schmidt et al. . | |
| 5,411,263 | 5/1995 | Schmidt et al. . | |
| 5,417,559 | 5/1995 | Schmidt . | |
| 5,429,365 | 7/1995 | McKeighen . | |
| 5,507,985 | 4/1996 | Cadorniga . | |
| 5,511,779 | 4/1996 | Meyers et al. | 473/246 |
| 5,513,844 | 5/1996 | Ashcraft et al. . | |
| 5,577,726 | 11/1996 | Fenton | 473/305 |

*Primary Examiner*—Raleigh W. Chiu
*Attorney, Agent, or Firm*—Kolisch, Hartwell, Dickinson, McCormack & Heuser

[57] ABSTRACT

A golf club head, and more specifically a hosel for a golf club head, and a method of angularly orienting a golf club shaft relative to a golf club head. The hosel defines a hollow interior for receiving a golf club shaft through an opening, generally along a central longitudinal axis of the hollow interior. The hollow interior is bounded by a substantially noncylindrical wall adjacent the opening, preferably including a substantially planar portion. A cross section of the wall taken approximately perpendicular to the central longitudinal axis preferably is substantially rectangular.

15 Claims, 3 Drawing Sheets

GOLF CLUB HEAD WITH ENLARGED HOSEL

CROSS-REFERENCE TO RELATED APPLICATIONS

This application is a continuation-in-part of U.S. design patent application Ser. No. 29/058,549, entitled "Hosel for a Golf Club," filed on Aug. 19, 1996.

BACKGROUND AND SUMMARY OF THE INVENTION

In the game of golf, a golf club is used to hit a golf ball along a fairway often several hundred yards long, with the ultimate goal of putting the golf ball into a cup just a few inches wide. Simply stated, the object of the game is to put the ball into the cup with as few hits as possible, and it requires great skill and accuracy to meet this goal consistently. While both skill and accuracy are a function of the physical and mental abilities of the golfer, a golfer's equipment has been found to play an important role as well.

For example, some golfers may find they consistently "slice" shots hit with one club (the ball veers to one side of the intended direction), "hook" shots hit with another club (the ball veers to the other side of the intended direction), and hit accurately with yet a third club. Slicing or hooking a shot generally means that the shot will not be as accurate as one without slicing or hooking. Similar variations may be found in the distance the ball travels when hit by a particular golfer. Since the accuracy and distance of shots are key factors in winning at golf, a broad range of types and styles of golf clubs have been developed.

A golf club is made up of a shaft by which the club is held by a player and swung, and a head at one end of the shaft for striking a golf ball when the club is swung. The head is attached to the shaft by a shaft-receiving socket formed in the head. This socket is known as the hosel of the head. Conventionally, the hosel fits tightly over the shaft, and the head is bonded to the shaft by epoxy.

Clubs are grouped broadly as woods and irons, with woods having a type of head designed for long distance hits (or drives), and irons having heads designed for shorter hits, or special-situation hits like hitting a ball out of tall grass or a sand trap, or putting the ball when on the green. Particular clubs may be distinguished from others generally by the length and weight of the shaft, the size and weight of the head, and the geometric configuration of the head that determine various angles and displacements of the shaft relative to the ball-striking face of the head. Typically, a club designed for hitting a ball a long distance has a longer shaft and a heavier head than a club designed for hitting the ball a shorter distance.

Since golfers come in all sizes, golf clubs come in various sizes. However, two golfers of the same height and arm length may prefer to play with clubs having different shaft lengths for a given head design, or having different head-to-shaft angles and displacements for a given shaft design. Thus, for optimum performance of a club, the shaft length must be matched to both the geometric configuration of the head and the player holding the shaft. Given the tight fitting hosels of conventional heads, this usually requires a compromise, with the head being chosen to approximate the desired angles and displacements, and the shaft length being matched just to the player, regardless of how this length may change the optimum ball-striking position of the head. All of this is complicated further by the fact that some golfers play with right-handed clubs having the hosel located on the left side of the head, while others play with left-handed clubs having the hosel on the right side of the head.

One way to avoid the compromise discussed above would be to manufacture a whole series of heads of a particular model line, providing a family of heads having a range of angles and displacements from which to choose. This can often be quite expensive for the head manufacturer, multiplying the number of molds required to make a line of heads, and complicating manufacturing and processing. It also requires that the manufacturer gauge market demand within each line of heads for each particular combination of angles and displacements.

For very demanding golfers, and particularly professional golfers, different angles and displacements may be identified for each type of club, and may be identified with such accuracy that the desired angles and displacements are not available from existing molds. Accordingly, the needs of many golfers simply are not met, or are met only at the expense of custom casting of the heads. Furthermore, the delay associated with custom casting may force many players to resort to heads that are readily available, to the detriment of their game.

There is thus a great need for some combination of golf club head and shaft that can be used to meet the exact needs of each golfer economically, accurately, and quickly. The embodiments disclosed herein do just that by providing a head with a hosel that is oversized relative to the shaft, and by attaching the head to the shaft at the desired angles and displacements through the use of an insert interposed the shaft and the hosel. The preferred rectangular shape of the interior of the hosel and the preferred design of the shaft, each described in detail below, have been found to provide a superior combination of customizability and playability for the resulting golf clubs.

U.S. Pat. Nos. 3,625,513 and 3,907,446 show golf clubs with heads attached to shafts by hosels that provide minimal adjustability of shaft-to-head angles. However, in both of these patents the hosel is shown to be relatively close-fitting with the shaft, and cylindrical to match the cylindrical shape of the shaft. This allows only the most minimal adjustments of angles, and leaves no room for adjusting the displacements of the head relative to the shaft, as discussed in more detail below.

It is common for a wood to be swung with a head velocity of over 100 mph. Accordingly, conventional wisdom has required a tight-fitting hosel to prevent bending, breaking, or creating excessive shock or vibration. Thus, a typical golf club has a steel shaft with a tight-fitting hosel at one end and further includes a shock-absorbing grip at the other end of the shaft. Even with the partially adjustable heads in U.S. Pat. Nos. 3,625,513 and 3,907,446, this wisdom dictated close-fitting hosels very similar to the tight-fitting hosels of conventional design.

U.S. Pat. No. 5,513,844 discusses club fitting in the context of what is described as a club-fitting apparatus. However, the apparatus requires the use of a number of different club heads, each having a hosel at different angles, with the hosel releasably clamping a shaft in a close-fitting relationship. Furthermore, the apparatus does not appear to be intended for more normal golf use. Rather, it is described only with respect to testing clubs, not playing with them. Accordingly, the apparatus of U.S. Pat. No. 5,513,844 does not provide a desirable solution to the problems addressed by the present invention.

The present invention, in various embodiments described in more detail below, shows that the conventional hosel design is subject to great improvement. This results in greatly improved golf clubs that are easier to manufacture. The improvements are noticeable when a head including one of the various hosels described herein is used on a conventional shaft, and even more noticeable when such a head is combined with an appropriately selected shaft.

Additional objects and advantages of the present invention will be understood more readily after a consideration of the drawings and the Detailed Description of the Preferred Embodiment.

DETAILED DESCRIPTION OF THE PREFERRED EMBODIMENT

Figure 1:
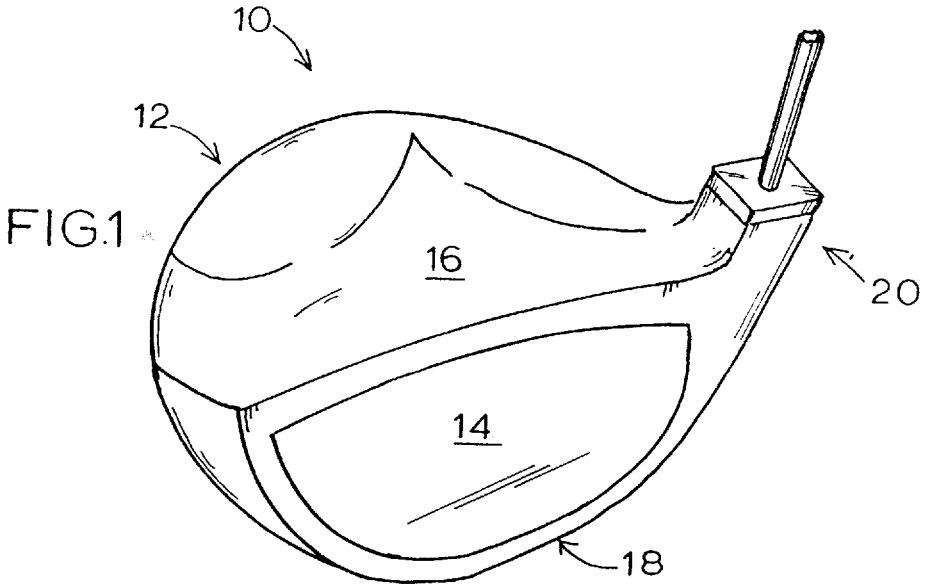
FIG. 1 is an isometric view of a right-handed golf club incorporating the present invention, with a portion of a shaft shown attached to a golf club head, taken generally from the front of the head.

Referring first to FIG. 1, a golf club is indicated generally at 10, comprising a golf club head 12. Head 12 may be any type of head and is shown in the drawings as a hollow metal "wood." Alternatively, head 12 may be an "iron."

Figure 2:
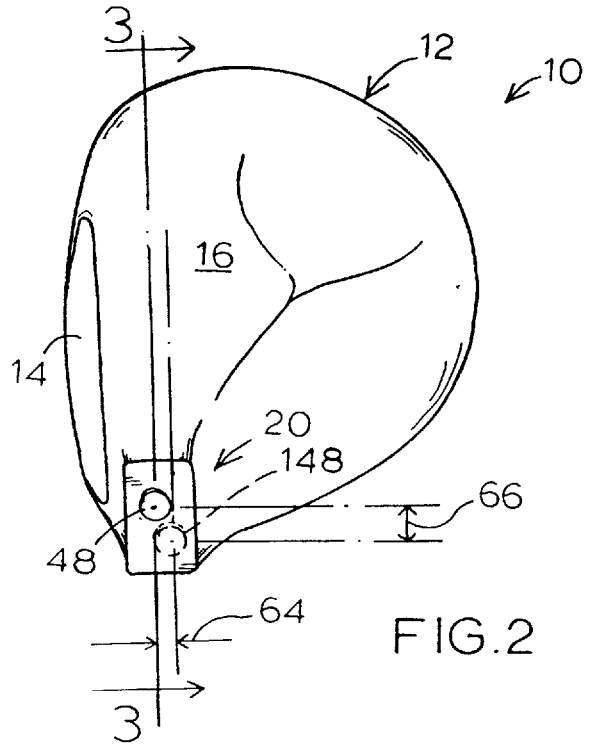
FIG. 2 is a top plan view of the golf club shown in FIG. 1, shown on a slightly smaller scale.

Head 12 includes a striking face 14, a top 16, and a bottom 18. Bottom 18 is partially obscured in FIG. 1. In FIG. 2, a different view of club 10 is shown, with bottom 18 being fully obscured. A hosel 20 is formed adjacent one side of head 12.

Figure 3:
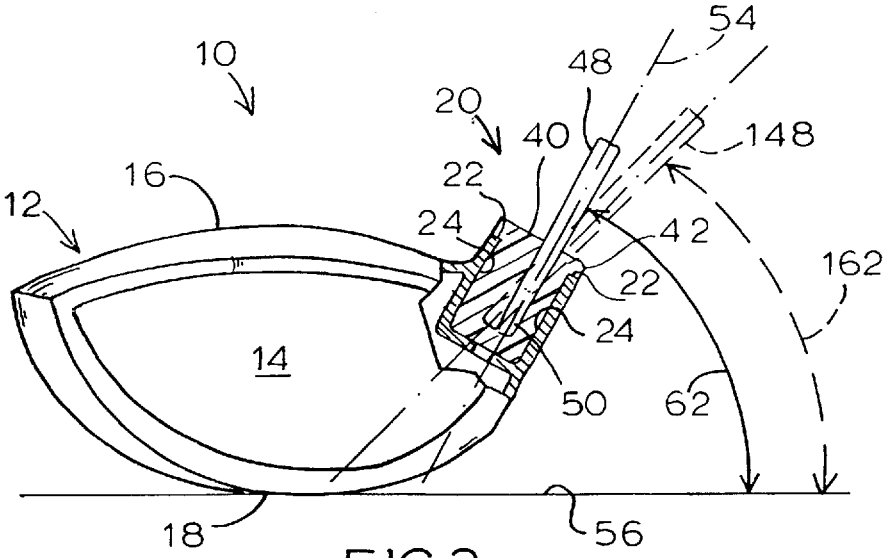
FIG. 3 is a front elevation of the club shown in FIG. 1, with the hosel of the club shown in cross section, taken generally along line 3—3 in FIG. 2, and with an alternative position of the shaft relative to the head shown in dashed lines.
Figure 4:
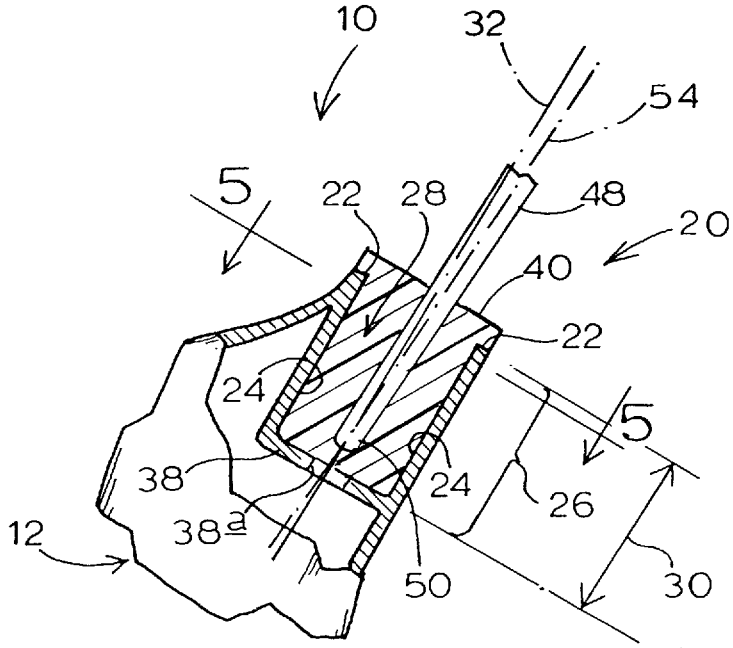
FIG. 4 is an enlarged cross-sectional view similar to that shown in FIG. 3, with only the hosel portion of the head shown.
Figure 5:
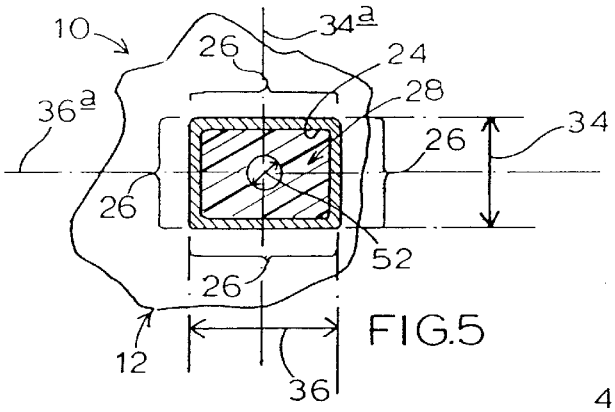
FIG. 5 is a top cross-sectional view of the hosel of the head shown in FIG. 2, taken generally along line 5—5 in FIG. 4.

The specifics of hosel 20 are shown best in FIGS. 3—5, each showing a cross-sectional view of hosel 20. An upper edge 22 defines an opening in hosel 20. Boundary structure preferably in the form of an axial interior sidewall or wall 24 having a plurality of substantially planar portions 26 defines a hollow interior 28. Thus, hollow interior 28 is bounded by a substantially noncylindrical wall 24, 26 adjacent the opening. Hollow interior 28 has a depth indicated in FIG. 4 at 30, and a central longitudinal axis indicated at 32 extending through the opening defined by upper edge 22.

Each substantially planar portion 26 preferably is substantially parallel to central longitudinal axis 32. When viewed as in FIG. 5, wall 24 has a cross section that is substantially rectangular or rectilinear in shape, with the cross section taken approximately perpendicular to central longitudinal axis 32 and to wall portions 26. Preferably, the cross section of wall 24 has significantly rounded comers to provide a visually pleasing appearance to hosel 20.

It will be seen that cross section 24 includes a width 34, measured along a short transverse axis indicated at 34*a*. Cross section 32 also has a length 36, measured along a long transverse axis 36*a*. Width 34 and length 36 provide an additional way to describe hosel 20. Width 34 is a first transverse dimension of hollow interior 28 that is bounded by first portions 26 of interior wall 24 along a first line 34*a* that intersects longitudinal axis 32 at approximately a right angle. Length 36 is a second transverse dimension of hollow interior 28 that is bounded by second portions 26 of interior wall 24 along a second line 36*a* that also intersects longitudinal axis 32 at approximately a right angle. First transverse dimension 34 is preferably substantially less than second transverse dimension. 36.

In the embodiments shown in FIGS. 3 and 4, a bottom 38 is formed as part of hosel 20, further defining hollow interior 28. A hole 38*a* may be formed in bottom 38, as shown in FIG. 4.

Figure 6:
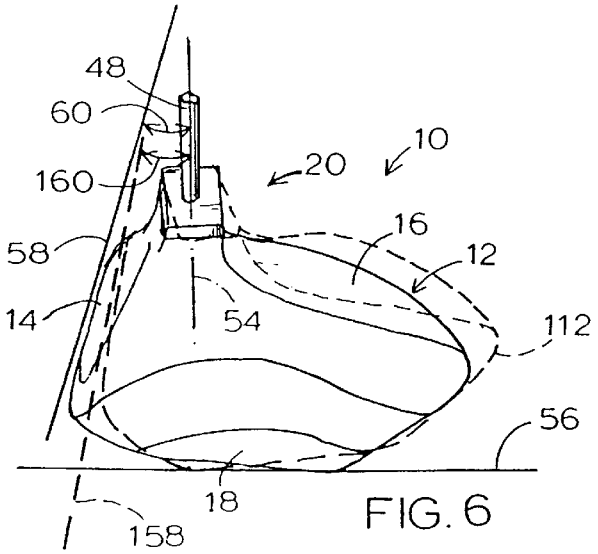
FIG. 6 is a right side elevation of the club shown in FIG. 2, with an alternative position of the head relative to the shaft shown in dashed lines.
Figure 7:
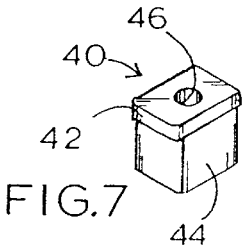
FIG. 7 is an isometric view of an insert fitting in the hosel shown in FIGS. 1—6.

Hollow interior 28 receives an insert 40, preferably predefined to conform in shape to hollow interior 28 prior to its placement in hosel 20, as shown in FIG. 7. Insert 40 preferably includes a collar 42 that limits the extent to which insert 40 may be inserted into hollow interior 28. The portion of insert 40 that is received by hollow interior 28 is indicated as a hosel-conforming external portion 44 that is of an external shape that conforms closely to the boundary structure of hosel 20. A hole 46, seen best in FIG. 7, is formed in insert 40 to receive an elongate shaft 48, seen in FIGS. 1–6.

Insert 40 is the device by which head 12 is attached to shaft 48. It is also the device by which shaft 48 is received by hosel 20, through the opening of hosel 20 that is defined by upper edge 22 so that a portion of shaft 48 is encompassed by hollow interior 28. Insert 40 may be formed, as by molding or other suitable method, of a polymer or other suitable material. The combination of head 12, insert 40, and shaft 48 may be held together by epoxy. Alternatively, a settable or curable adhesive may be applied to the adjoining surfaces of hosel 20, insert 40, and shaft 48, and set or cured through the application of heat, microwave energy, or by other devices or methods.

Figure 8:
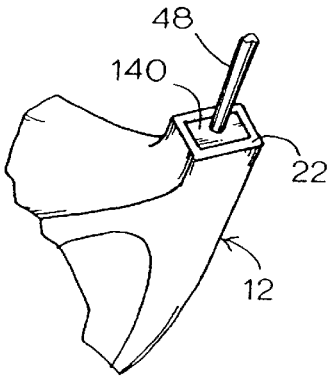
FIG. 8 is a fragmentary isometric view of a hosel portion of an alternative embodiment of the golf club, taken from the upper left front corner of the head, as shown in FIG. 1.
Figure 9:
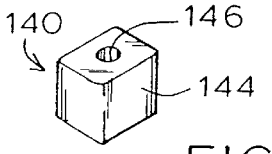
FIG. 9 is an isometric view of the insert of the embodiment shown in FIG. 8.

An alternative embodiment of the insert is shown in FIGS. 8 and 9, indicated as insert 140. In this embodiment, the collar is omitted, and upper edge 22 is exposed as shown. An external portion 144 and a hole 146 are indicated, similar to those shown in the embodiments of FIGS. 1–7. The cross-sectional view of the hosel/insert of the embodiment of FIGS. 8 and 9 would be identical to that shown in FIG. 5, but with different reference characters.

As indicated in FIG. 3, shaft 48 has a hosel portion or head-mounting end 50 that is received and encompassed by insert 40, and in turn by hosel 20. An outer diameter 52 of hosel portion 50 is indicated in FIG. 5, and is of a size relative to width 34 and length 36 of hollow interior 28 such that hollow interior 28 is substantially larger than mounting end 50, with first dimension 34 being at least one-and-a-half times outer diameter 52 of hosel portion 50, and second dimension 36 being at least two times outer diameter 52. Hosel portion 50 of shaft 48 includes an outer profile that may be cylindrical, as with most conventional shafts, or a very slightly tapered frustum of a cone, such as is shown in U.S. Pat. No. 5,569,099, incorporated herein by reference.

One benefit of the hosel of the present invention is that, as part of the attachment of shaft 48 to a particular head 12, the size and configuration of hollow interior 28 of hosel 20 allows substantial adjustment of shaft 48 relative to head 12. These adjustments allow head 12 to be selectively oriented relative to shaft 48 through the orientation of hole 46 in insert 40, as best demonstrated with reference to what is defined herein as the "normal" position of head 12 with respect to a level playing surface. Once a normal position is defined, changes in club 10 may be described as relative changes in the orientation of shaft 48 as it is fixed to head 12. To aid in such descriptions, a longitudinal shaft axis 54 is indicated in FIGS. 3 and 4, as defined by shaft 48, and a level playing surface or ground plane is represented by line 56 in FIGS. 3 and 6.

The normal position of club head 12 is defined as the orientation of head 12 when it is in its optimum ball-striking position. Further definition of the normal position is complicated by the fact that most head designs are highly complex curvilinear shapes, making it difficult to establish a starting reference point. However, if the reader will envision head 12 as an item fixed in space in one specific orientation, such as is shown in each of the figures, the following descriptions may be more clear.

One adjustment of the fixing of shaft 48 to head 12 effectively changes the loft or striking angle of the club. When the club is viewed as shown in FIG. 6, it will be seen that face 14 approximately defines a face plane extending into and out of the sheet, represented by line 58. The angle of line 58 relative to shaft axis 54 is the striking angle, or, more generally, the loft, of the club. Two possible striking angles are indicated in FIG. 6 through changes in the orientation of shaft 48 relative to head 12, which result in a shift of head 12 from its normal position if shaft 48 is held fixed in space. A first striking angle is shown in solid lines at 60. A second striking angle is shown with head 112 in dashed lines, shifted from its normal position. The face plane is represented by line 158 and the striking angle is shown at 160. A change in striking angle impacts the performance of club 10 because a ball hit by a golf club generally leaves the ground at a higher angle as the striking angle or loft gets greater. This may change the distance or accuracy of a shot hit with the club, and also may allow a player to hit a ball over an obstacle that would otherwise be unavoidable.

Another adjustment changes what is known as the lie angle of the club. Turning to FIG. 3, two possible lie angles are shown, the first with shaft 48 in solid lines, and the second with shaft 148 in dashed lines. The lie angles are indicated at 62 and 162, respectively. Lie angles generally are selected to match a particular length of shaft to a particular player. Some players may prefer longer shafts than others, even among players who all grip the shaft at the same height relative to the ground. The result is that, the longer the shaft, the farther away the head is from the player.

If the lie angle is not matched to the shaft length, some players may have difficulty getting optimum performance out of the resulting club because the head will be tilted away from its optimum, normal position. In FIG. 3, head 12 is shown in its untilted, optimum, normal position, and the shaft is shown in alternative positions. Thus, the adjustments made in the fixing of shat 48 to head 12 serve different purposes with respect to striking angle and lie angle. The striking angle is changed to alter the performance of the resulting club to suit the player. The lie angle, on the other hand, typically is changed to fit the club to the player without tilting the head from its normal position, which would change the performance of the resulting club.

In addition to the angles discussed above, shaft 48 may be fixed closer to or farther from face 14, with lateral displacements measured along transverse axes 34*a* and 36*a* of hosel 20. These lateral displacements may be seen in FIG. 2, in which shaft 48 is shown in solid lines, concentric with central longitudinal axis of hosel 20, and a displaced shaft 148 is shown in dashed lines. A first lateral displacement is indicated at 64, and a second lateral displacement is indicated at 66, both with respect to the principal lateral axes 34*a* and 36*a* of hosel 20.

To assemble a club from a head 12 having a hosel 20 shaped as described above, the golfer for whom the club is made is measured to determine proper length of a shaft 48, a particular type of shaft 48 and head 12 are selected based on the golfer's preferences, and the golfer's game is analyzed to refine shaft length and to determine optimum shaft-to-head angles and displacements. An insert 40 is made of suitable material to conform to hosel 20. Insert 40 is held in a jig or drill press, and a shaft-conforming hole 46 is formed in insert 40 at the desired angles and displacements. Insert 40 is bonded to shaft 48 and hosel 20 to form a finished club 10. Ideally, the bonding of insert 40 to hosel 20 and shaft 48 is reversible, so that multiple inserts 40, each having a different combination of shaft-to-head angles and displacements, may be experimented with by the golfer to establish the optimum overall geometric configuration of club 10.

From the foregoing identification of the elements and references points of club 10, it will be seen that numerous different descriptions of club 10 of the present invention are possible. Furthermore, the present invention includes a method of angularly orienting golf club shaft 10 relative to golf club head 12. The method includes the steps of providing a shaft 48 with a head-mounting end 50 thereon and providing a head 12 with a hosel 20 formed therein.

It further includes the steps of providing an insert 40 sized to conform to the boundary structure of hosel 20 and fixing insert 40 to the boundary structure of hosel 20. Additional steps include forming in insert 40 a hole 46 sized to conform to head-mounting end 50 of shaft 48 and oriented to place hole 46 at a desired angle relative to head 12 when insert 40 is fixed to the boundary structure of hosel 20, and fixing shaft 48 within hole 46. Insert 40 and hole 46 may be formed substantially simultaneously by placing shaft 48 into hollow interior 28 at the desired angle for hole 46, and placing filler material into hollow interior 28 so that the filler material encompasses at least a portion of head-mounting end 50 of shaft 48. Alternatively, insert 40 and hole 46 may be formed before insert 40 is fixed to hollow interior 28 of hosel 20. Preferably, insert 40 is first formed from suitable material and then hole 46 is formed by drilling.

As discussed above, the various embodiments of head 12, including the different designs of hosel 20, may be combined with any style shaft to form a finished golf club. However, it is believed that the enlarged hosel 20 of the various embodiments is particularly suited for use with a gripless golf club shaft as is described in copending U.S. patent applications Ser. Nos. 60/018,882 and 60/023,488. In those applications, a shaft is described that includes a first elongate segment for mounting to a golf club head, formed by wrapping sheet material around a substantially cylindrical, but very slightly tapered mandrel. The shaft also includes a second elongate frustoconical segment for gripping by a golfer, formed around the first segment and around a slightly frustoconical end segment of the mandrel to produce a smoothly tapering exterior surface of the shaft and an abrupt interior region of joinder between the segments. One such invented shaft is available commercially from AJ Tech, Inc., 2590 Pioneer Avenue, Vista, Calif. 92083, as its 9000™shaft.

The joinder between the shaft segments preferably is approximately two-thirds of the way from the head-mounting end of the shaft. The shaft tapers such that the outer diameter of its head-mounting end is less than approximately one-third the outer diameter of its gripping end. The shaft also includes an ergonomically designed gripping end, allowing the shaft to be used without the conventional addition of a grip. The shape and smooth, hard surface of the gripping end allows for a great variety of performance-enhancing techniques, by applying padding, adhesives, and/or lubricants to selected portions of the shaft or to a golfer's hands.

While the present invention has been shown and described by reference to selected embodiments, it will be apparent to those skilled in the art that other changes in form and detail may be made therein without departing from the spirit and scope of the appended claims.

I claim:

1. A golf club for use in striking a golf ball, the club comprising:

an elongate shaft having a mounting end;

a golf club head attached to the shaft, the head including a face for striking a golf ball and including a hosel for receiving the mounting end of the shaft; and an insert operatively connected to the shaft and the head, wherein the hosel includes a hollow interior for encompassing the mounting end of the shaft and receiving the insert for attaching the head to the shaft, the hollow interior being substantially larger than the mounting end of the shaft so that the face of the head can be selectively oriented relative to the shaft by changing the orientation of the shaft relative to the hosel.

2. The golf club according to claim 1, wherein:

the shaft is approximately cylindrical, and defines a longitudinal axis;

the shaft includes a hosel portion inserted into the hollow interior, the hosel portion having an outer diameter;

the hollow interior is defined by sidewalls; and a first dimension of the hollow interior, measured between first portions of the sidewalls along a first line that intersects the longitudinal axis of the shaft at approximately a right angle, is at least one-and-a-half times the outer diameter of the hosel portion of the shaft.

3. The golf club according to claim 2, wherein a second dimension measured between second portions of the sidewalls of the hollow interior along a second line that intersects the longitudinal axis of the shaft at approximately a right angle is at least two times the outer diameter of the hosel portion of the shaft.

4. The golf club according to claim 1, wherein the hollow interior of the hosel is at least partially defined by a substantially planar wall.

5. The golf club according to claim 4, wherein the hollow interior of the hosel is defined by boundary structure including the substantially planar wall, and a cross section of the boundary structure taken approximately perpendicular to the planar wall is substantially rectangular.

6. The hosel according to claim 5, wherein the cross section of the boundary structure has significantly rounded corners.

7. The hosel according to claim 4, wherein the hollow interior of the hosel is defined by boundary structure including the substantially planar wall, and a cross section of the boundary structure taken approximately perpendicular to the planar wall has significantly rounded corners.

8. The golf club according to claim 1, wherein the hollow interior of the hosel is defined by boundary structure, and a cross section of the boundary structure taken approximately perpendicular to the shaft is substantially rectangular.

9. The hosel according to claim 8, wherein the cross section of the boundary structure has significantly rounded corners.

10. The hosel according to claim 1, wherein the hollow interior of the hosel is defined by boundary structure, and a cross section of the boundary structure taken approximately perpendicular to shaft has significantly rounded corners.

11. The golf club according to claim 1, wherein the hollow interior of the hosel is defined by boundary structure, and a substantial portion of the insert is of an external shape that conforms closely to the boundary structure of the hosel.

12. A method of angularly orienting a golf club shaft relative to a golf club head, comprising the steps of:

providing a shaft with a head-mounting end thereon;

providing a head with a hosel formed therein, the hosel including a hollow interior for receiving the shaft along a longitudinal axis, and the hollow interior being defined by boundary structure having differential cross-sectional dimensions when measured along lines that intersect the longitudinal axis at approximately right angles;

providing an insert sized to conform to the boundary structure of the hosel;

fixing the insert to the boundary structure of the hosel;

forming in the insert a hole sized to conform to the head-mounting end of the shaft, the hole oriented to place the hole at a desired angle relative to the head when the insert is fixed to the boundary structure of the hosel; and fixing the shaft within the hole in the insert.

13. The method according to claim 12, wherein the insert and the hole in the insert are formed substantially simultaneously by placing the shaft into the hollow interior of the hosel at the desired angle for the hole, and placing filler material into the hollow interior of the hosel so that the filler material encompasses at least a portion of the head-mounting end of the shaft.

14. The method according to claim 12, wherein the insert and the hole in the insert are formed before the insert is fixed to the hollow interior of the hosel.

15. The method according to claim 12, wherein the insert is formed and then the hole in the insert is formed by drilling.

* * * * *